340-566 SR
6/11/85 XR 4,523,186

United States Patent [19]

Fiarman

[11] Patent Number: 4,523,186

[45] Date of Patent: Jun. 11, 1985

[54] SEAL SYSTEM WITH INTEGRAL DETECTOR

[75] Inventor: Sidney Fiarman, Port Jefferson, N.Y.

[73] Assignee: The United States of America as represented by the United States Department of Energy, Washington, D.C.

[21] Appl. No.: 407,663

[22] Filed: Aug. 12, 1982

[51] Int. Cl.[3] ..... G08B 13/18

[52] U.S. Cl. ..... 340/555; 340/531; 340/566; 340/568; 340/600

[58] Field of Search ..... 340/531, 555, 566, 568, 340/600; 350/96.15, 96.20, 96.23, 96.24

[56] References Cited

U.S. PATENT DOCUMENTS

| | | | |
|---|---|---|---|
| 3,938,124 | 2/1976 | Way et al. | 340/555 |
| 4,144,530 | 3/1979 | Redfern | 340/566 |
| 4,262,284 | 4/1981 | Stieff et al. | 340/568 |
| 4,292,628 | 9/1981 | Sadler | 340/531 |

OTHER PUBLICATIONS

Kennepohl et al., "The Electronic Sealing System, VACOSS . . . ", Nuclear Safeguards Technology 1978, vol. I, pp. 617–624, Vienna, 1979.

Arning et al., "Electronic Sealing Systems", 1st Seminar on Containment & Surveillance . . . , presented at Joint Research Centre, Ispra Establishment, Sep. 17–19, 1980.

*Primary Examiner*—Glen R. Swann, III

*Attorney, Agent, or Firm*—Vale P. Myles; Paul A. Gottlieb; Judson R. Hightower

[57] ABSTRACT

There is disclosed a seal system for materials where security is of the essence, such as nuclear materials, which is tamper-indicating, which indicates changes in environmental conditions that evidence attempts to by-pass the seal, which is unique and cost effective, said seal system comprised of a seal where an optical signal is transmitted through a loop, with a detector to read said signal, and one or more additional detectors designed to detect environmental changes, these detectors being operatively associated with the seal so that detection of a break in the optical signal or detection of environmental changes will cause an observable change in the seal.

7 Claims, 2 Drawing Figures

SEAL SYSTEM WITH INTEGRAL DETECTOR

BACKGROUND OF THE INVENTION

The U.S. Government has rights in this invention pursuant to Contract Number DE-AC02-76CH00016, between the U.S. Department of Energy and Associated Universities, Inc.

This invention relates to seal systems, and more particularly to seal systems intended to detect and indicate unauthorized attempts to obtain access to valuable material, such as nuclear material.

A seal, as herein understood, has a body or housing which closes a loop. The loop secures the sealed item in such a way that it must be removed in order to use, move or have access to the sealed item. For example, a valve may be sealed by a wire loop closed by pressing the ends of the wire into a small piece of lead. To increase security the body or housing may be provided with a unique identification in order to make it more difficult for an unauthorized person to simply remove and replace the seal without detection. Thus, the simple wire seal described above may have a symbol embossed into the lead body.

Such a seal must have certain physical properties: (1) the housing and loop must be tamper-indicating, i.e., attempts to defeat the seal must be obvious to an inspector; (2) the identification of the seal must be unique, i.e., it should not be possible to remove and replace the seal with a duplicate, except at an excessive cost; and (3) the cost of the seal and the effort to inspect it must be reasonable for the application.

As the security of the item to be sealed becomes more important more effort must be put into insuring that the seal is both tamper-indicating and unique, necessarily increasing the cost of the seal. In applications such as the protection of nuclear materials seal manufacturers must go to elaborate lengths to insure that their seals have good tamper-indicating qualities and are sufficiently unique since it must be assumed that persons attempting to obtain undetected access to nuclear materials will be willing to go to great expense and effort to defeat the seals.

Typical seals which have been developed for nuclear security applications are of the type wherein an optical signal is transmitted through a loop comprising a fiber optics cable, closing said loop serving to secure the item to be sealed, and the transmitted signal is detected by an optical detector so that attempts to open or tamper with the loop will cause a change in the optical signal to be detected. Detection of such a change in the optical signal causes an observable change in the state of the seal which cannot easily be reversed by unauthorized persons. Typically such a seal might have a visual display which changes periodically in accordance with an arbitrary pseudorandom pattern known only to authorized persons. This pattern would be changed in response to an unauthorized attempt to obtain access to the secured item and could not be restored by unauthorized persons. Housings for such seals may be made tamper-indicating by any of a number of well known techniques; for example, the seal housing may be pressurized and a pressure sensor used to detect any attempts to open the housing. In general, such seals and methods for insuring that they are tamper-indicating are well known and a further discussion of them is not believed necessary to an understanding of the present invention.

When items such as nuclear material are to be sealed the possibility that attempts to bypass the seal, such as by penetrating the vessel containing the nuclear material, must be considered. For this reason seals should be coupled with various types and combinations of detectors, such as vibration, motion or radiation detectors. Incorporating such detectors into seal systems will permit detection of attempts to bypass the seal. Of course, the detectors must have essentially the same properties of tamper-indication, uniqueness and cost-effectiveness as the seal in order to form an effective seal system. It is easy to see that a complete seal system designed to secure items such as nuclear materials may prove to be highly complex and expensive.

Thus, it is an object of the present invention to provide a single apparatus which forms an effective seal system.

It is a further object of the present invention to provide such a seal system while minimizing the cost of insuring that the seal system is tamper-indicating and unique.

BRIEF SUMMARY OF THE INVENTION

The disadvantages of the prior art are overcome and the above objects are achieved by means of a seal system comprising a seal of the type wherein an optical signal, which may be pulsed, is transmitted through a loop comprising a fiber optics cable, closing said loop serving to secure the item to be sealed. The transmitted signal is detected by an optical detector so that attempts to open or tamper with said loop which cause changes in said signal will be detected and will cause an observable change in the state of the seal. The seal system also comprises a second detector, such as a motion, vibration or radiation detector, for detecting significant changes in the local environment which might indicate an attempt to gain access to or tamper with the sealed item, the detector being operatively associated with the seal so that detection of such environmental changes will also cause an observable change in the state of the seal.

Preferably such a seal system would have the signal from the detector interrupt or interfere with the optical signal, causing the seal to react essentially as though the loop were opened or tampered with.

Thus, it may be seen that the seal system of the present invention advantageously provides a system wherein a single inspection will reveal both if the seal has been opened or tampered with and if attempts to bypass the seal have been made.

It is a further advantage of the present invention that the seal and the second detector may share unique circuitry, and may share, or use an identical tamper-indicating housing, thereby reducing the cost of the seal system.

Other objects and advantages of the present invention will become apparent to those skilled in the art from consideration of the attached drawings and the detailed description set forth below.

DETAILED DESCRIPTION OF EMBODIMENTS OF THE INVENTION

Figure 1:
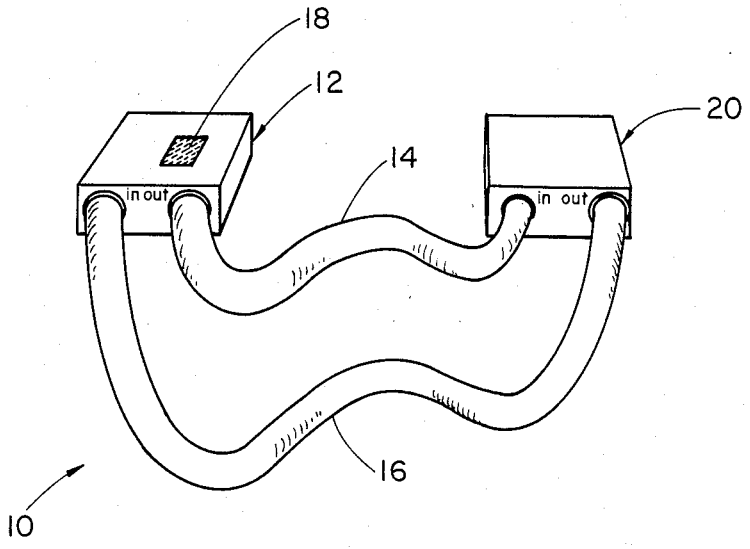
FIG. 1 shows a seal system in accordance with the present invention.

Turning to FIG. 1, there is shown a seal system 10 in accordance with the subject invention. Tamper-indicating housing 12 contains electronics which transmit optical signals through fiber optics cable 14 to detector housing 20 which may be substantially identical to housing 12. Housing 20 contains electronics which detect and retransmit the optical signals back to housing 12. (By optical signals herein is meant electromagnetic signals, normally in the visible spectrum, but which may range into the ultraviolet or infrared.)

The electronics in housing 12 are designed to detect any changes in the retransmitted signal such as changes caused by opening the loop comprising fiber optics cables 14 and 16, or by attempts to tamper with seal system 10. Suitable electronics for the generation and detection of optical signals are taught in U.S. Pat. No. 4,292,628 to Sadler for a "Fibre Optic Security System", issued Sep. 29, 1981, which is hereby incorporated by reference.

If such a change in the optical signal, which may be continuous, pulsed or otherwise modulated, is detected, display 18 on housing 12 is changed so that evidence of attempts to gain unauthorized access to the sealed item will be readily observable to inspectors.

Typically display 18 will be a visual display, such as a light emitting diode display, which changes periodically according to an arbitrary, pseudorandom pattern based on information stored in the electronics in housing 12. Detection of a change in the optical signal causes destruction of this information, so that the display pattern cannot be restored by unauthorized persons.

Figure 2:
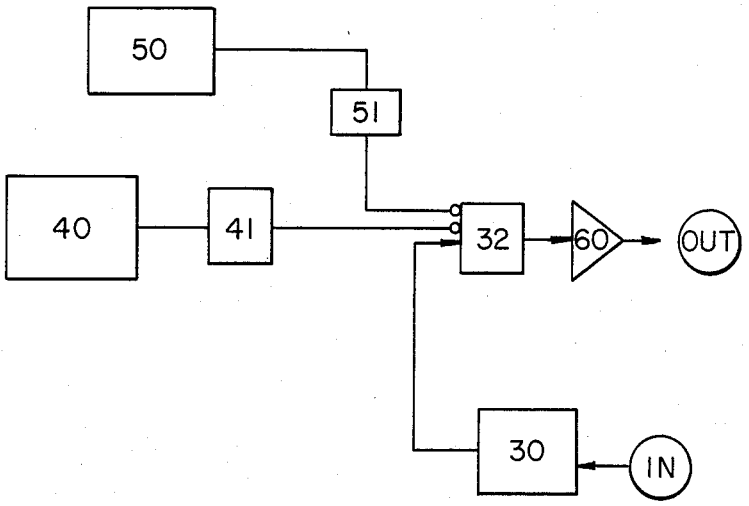
FIG. 2 is a logic schematic of the relationship between the seal optical signal and the detectors in the seal system of the present invention.

Turning to FIG. 2, a logic diagram showing the logic circuitry in tamper-indicating housing 20 is shown. The optical signal from fiber optics cable 14 is detected by optical detector 30. In response to the optical signal, detector 30 generates a logical signal which passes through "AND gate" 32 and triggers optical generator 60 to retransmit the optical signal over fiber optics cable 16. Gate 32 is enabled by the absence of output from either of the detectors connected to "AND gate" 32. In the embodiment shown, a radiation detector 50, to detect changes in background radiation, and a load cell 40, to detect movement, are used. However, other combinations of detectors are within the contemplation of the present invention, their choice depending upon the particular application. Logic box 51 is placed between radiation detector 50 and "AND gate" 32 while logic box 41 is placed between load cell 40 and "AND gate" 32.

Any change in the background radiation and/or the weight sensed by load cell 40 will cause the output of the corresponding detector to change, disabling "AND gate" 32 and interrupting the optical signal just as though the loop comprising cables 14 and 16 had been opened. Thus, the same electronic circuitry is used to insure uniqueness for the environmental detectors and the seal which comprise the seal system.

Circuitry to produce a signal which will disable "AND gate" 32 whenever the environmental property being monitored exceeds a threshold level is incorporated with detectors 40 and 50. These thresholds may be fixed, as for load cell 40, or may be based on an average of the level over a preselected preceding period of time, as for radiation detector 50, to allow for slow changes in the normal levels or drift in the detector.

It should be noted that each of the subsystems described above, the optical detector, "AND gate", optical generator, and the various environmental detectors and incorporated circuitry, are well known and numerous particular designs for carrying out their functions are known to those skilled in the art. Further, the embodiments described above are given by way of illustration only, and numerous other embodiments within the contemplation of the present invention will be apparent to those skilled in the art. In particular, it will be apparent that all the electronics and logic may be contained in a single tamper-indicating housing to form a seal system or conversely, that one or more detectors in separate housings may be inserted into the fiber optic loop. Thus, the limits of the present invention are to be found only in the claims set forth below.

I claim:

1. A seal system comprising:

(a) a seal of the type wherein an optical signal is transmitted through a loop, comprising: a loop of fiber optics cable, closing said loop serving to secure an item to be sealed, and an optical detector to detect said transmitted signal so that attempts to open or tamper with said loop which cause alterations in said signal will be detected and will cause an observable change in the state of said seal;

(b) an environmental detector means for detecting changes in the local environment which might indicate an attempt to bypass the seal and tamper with the sealed item, said environmental detector means being operatively associated with said seal so that detection of such environmental change will also cause an observable change in the state of said seal;

(c) a first tamper-indicating housing, said housing containing circuitry for the transmission of an optical signal over said loop of fiber optics cable, for detection of a returned optical signal, and for provision of a unique observable change of state in response to a detected change in said returned signal;

(d) a second tamper-indicating housing, said second housing containing circuitry for detection and retransmission of said optical signal and at least said environmental detector means for detecting changes in the local environment, said environmental detector means being operatively associated with said detection and re-transmission circuitry so that detection of an environmental change will change said re-transmitted signal.

2. A seal system as described in claim 1, wherein the output of said optical detector is logically combined with the output of said environmental detector means, so that either a detected environmental change or a change in the optical signal will cause an observable change in the state of the seal.

3. A seal system as described in claim 1, wherein said optical signal is pulsed.

4. A seal system as described in claim 1, wherein detection of an environmental change blocks re-transmission of said optical signal so that said seal system responds to said environmental change as though said loop were opened.

5. A seal system as described in claim 1 wherein said environmental detector means includes a radiation detector.

6. A seal system as described in claim 1 wherein said environmental detector means includes a load cell to detect movement of said second tamper-indicating housing.

7. A seal system as described in claim 1 wherein said loop of fiber optics cables comprises a plurality of fiber optics cables connected respectively between said first and second tamper-indicating housings to form said loop.

* * * * *